United States Patent [19]

Projahn

[11] Patent Number: 4,982,565

[45] Date of Patent: Jan. 8, 1991

[54] PILOT BURNER FOR A DEVICE FOR BURNING SOLIDS IN THE EXHAUST GAS OF INTERNAL COMBUSTION ENGINES

[75] Inventor: Ulrich Projahn, Ditzingen, Fed. Rep. of Germany

[73] Assignee: Robert Bosch-GmbH, Stuttgart, Fed. Rep. of Germany

[21] Appl. No.: 458,144

[22] Filed: Dec. 28, 1989

[30] Foreign Application Priority Data

Feb. 2, 1989 [DE] Fed. Rep. of Germany ..... 3903065

[51] Int. Cl.[5] ..... F01N 3/02

[52] U.S. Cl. ..... 60/303

[58] Field of Search ..... 60/303; 431/258, 260, 431/262, 347

[56] References Cited

U.S. PATENT DOCUMENTS 4,672,808 6/1987 Leonhard ..... 60/286

4,858,432 8/1989 Knauer et al. ..... 60/303

*Primary Examiner*—Douglas Hart

*Attorney, Agent, or Firm*—Felfe & Lynch

[57] ABSTRACT

Pilot burner especially for a device for burning soot in the exhaust gas of diesel engines, including a hollow cylindrical mixing chamber 10 and glow plug chamber 11 connected transversely thereto via an opening 12. A fuel supply pipe 28 ends into the glow plug chamber 11 and an air supply pipe 18 ends into the mixing chamber 10. In the area of the spiral incandescent filament 28, the glow plug is coaxially surrounded by a protective tube 26 made of wire fabric. The fuel supply pipe 28 ends in an orifice extension piece 27 which extends radially into the glow plug chamber 11. The protective tube 26 has a large surface so that the fuel hitting thereon uniformly evaporates. The protective tube 26 is welded to a sleeve 37 which is screwed into glow plug chamber 11 and can hence be easily replaced.

4 Claims, 3 Drawing Sheets

PILOT BURNER FOR A DEVICE FOR BURNING SOLIDS IN THE EXHAUST GAS OF INTERNAL COMBUSTION ENGINEScBACKGROUND OF THE INVENTION

The invention concerns a pilot burner for a device for burning solid particles, particularly soot particles, in the exhaust gas of internal combustion engines. The pilot burner is of the kind disclosed in U.S. Pat. No. 4,858,432, which is hereby incorporated by reference.

U.S. Pat. No. 4,858,432 suggests enclosing the glow plug of a pilot burner in a protective tube. The fuel which is supplied to the pilot burner hits on the protective tube, is heated up and evaporates. From the protective tube the fuel enters a mixing chamber to which the air required for the burning is also supplied. In the mixing chamber there is a glow body disposed which serves to stabilize the flame during the burning of the fuel-air mixture.

SUMMARY OF THE INVENTION

It is an object of the invention to configure the pilot burner of the prior art so that the evaporation of the supplied fuel is further improved.

A pilot burner having a protective tube of fine-meshed wire fabric about the glow plug has the advantage that the surface is enlarged, thus achieving an improved evaporation of the fuel. When starting-up, the required preheating of the glow plug is hence very short. Moreover, the ignition of the fuel-air mixture is stabilized such that a glow body is no more required in the mixing chamber.

An improvement according to FIG. 3 permits an easy replacement of the protective tube.

DETAILED DESCRIPTION OF THE PREFERRED EMBODIMENTS

Figure 1:
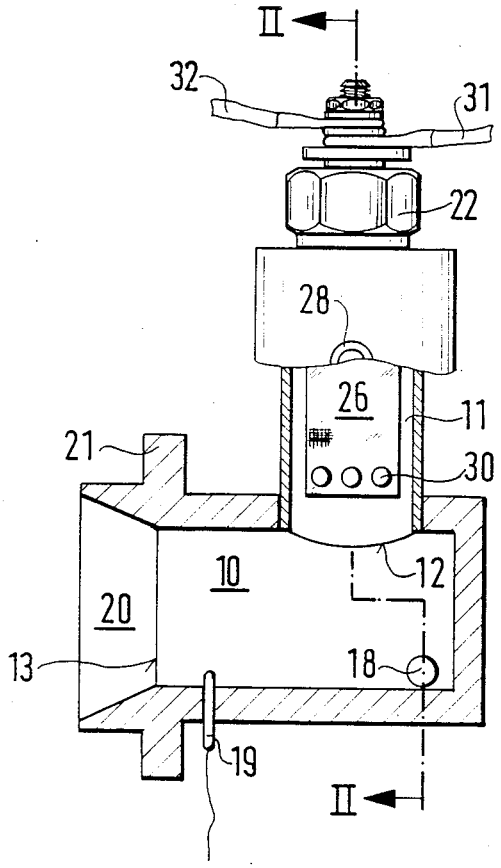
FIG. 1 is a longitudinal section of a pilot burner for a combustion device in motor vehicles.
Figure 2:
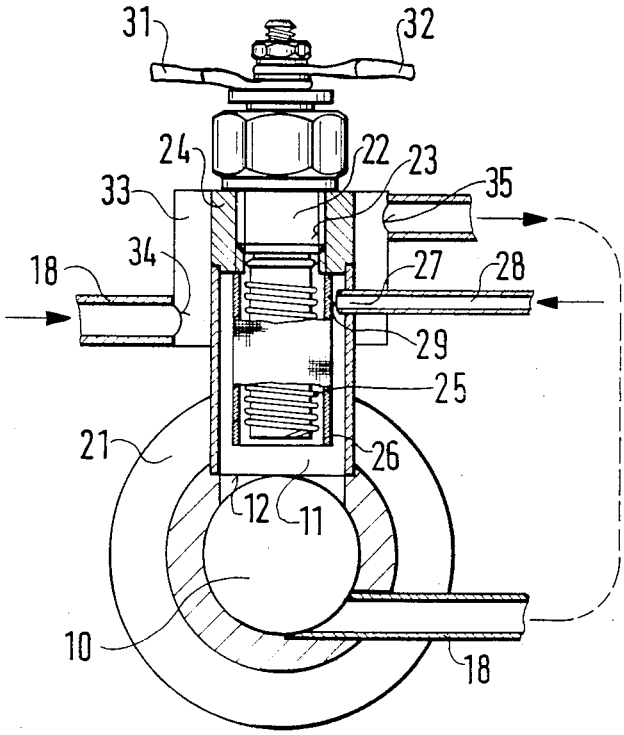
FIG. 2 is a section of a pilot burner taken along line II—II in FIG. 1.

The pilot burner represented in a longitudinal section in FIG. 1 and in a cross section in FIG. 2 includes a hollow cylindrical mixing chamber 10 and glow plug chamber 11. Both chambers 10, 11 are in a rectangular relationship to one another and their longitudinal axes are on one plane. When the pilot burner is built in, the mixing chamber 10 is approximately horizontal and the glow plug chamber 11 is vertical; with its one open front end the latter is inserted into a circular cylindrical opening 12 in the wall of the mixing chamber 10. The mixing chamber 10 is closed at the one front end and, at the other front end, it is provided with a mixture outlet 13 to which is connected the combustion device; the latter is not represented in further detail. Next to the closed front wall of the mixing chamber 10 is the ending of an air supply pipe 18 the flow direction of which is tangential with respect to the mixing chamber 10.

A glow plug 22 is held in a coaxial position in the glow plug chamber 11; with a plug connecting thread 23 and an inside thread segment 24, this glow plug is screwed to the end of the glow plug chamber 11 which faces away from the opening 12 (FIG. 2). With its spiral incandescent filament 25, the glow plug 22 closely approaches the opening 12 of the mixing chamber 10. In the vicinity of the spiral incandescent filament 25, the protective tube 26 coaxially encloses the glow plug 22 in a radial distance. The protective tube 26 is made of a multilayer, fine-meshed wire fabric. The wire fabric, for example, can be configured as a square-meshed fabric or a laced fabric. Plasma jet welding prevents a fraying of the the wire fabric at the free front end of the protective tube 26.

An orifice extension piece 27 of a fuel supply pipe 28 extends into the glow plug chamber 11 and the orifice 29 of this supply pipe 28 is directly in front of the external wall of the protective tube 26. Configuring the protective tube 26 as a wire fabric enormously enlarges the surface thereof and so ensures a very uniform evaporation of the fuel which reaches the protective tube 26. Since the wire fabric of the protective tube 26 heats up very rapidly there is only a short preheating of the glow plug 22 required. Power is supplied to the glow plug 22 via two electric connecting lines 31 and 32. In order to avoid an overheating of the electric connections, the glow plug chamber 11 is cooled in the area of the inside thread segment 24.

Figure 3:
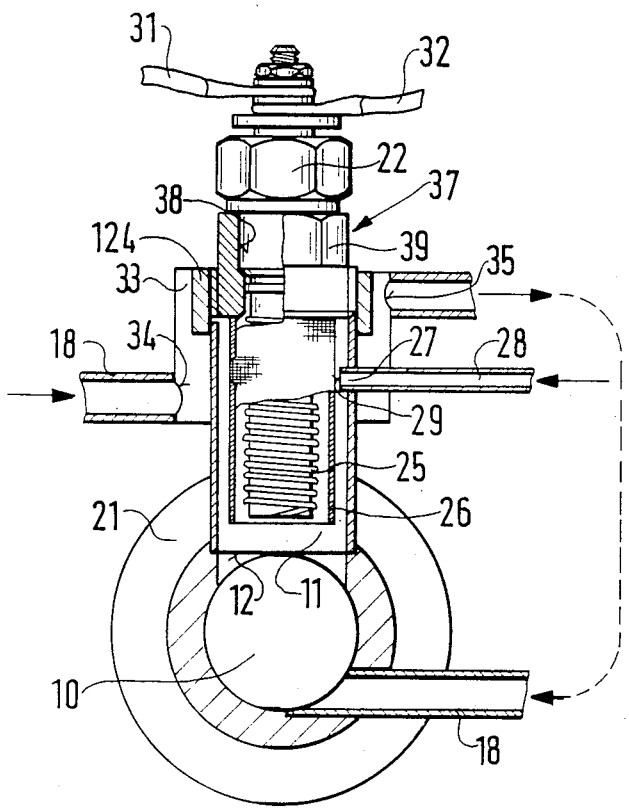
FIG. 3 is a section of the pilot burner according to line II—II in FIG. 1 with a second embodiment.

In a second embodiment, as represented in FIG. 3, the protective tube 26 is at its front end welded to a sleeve 37 which, in turn, is screwed into the inside thread segment 124 of the glow plug chamber. The sleeve 37 is provided with a threaded borehole 38 for holding the glow plug 22 and with a hexagonal head 39 in the area which extends out of the glow plug chamber 11. The sleeve 37 can easily be unscrewed and removed from the glow plug chamber 11 such that the protective tube 26 can be replaced without further problems.

In order to start up the combustion device, the glow plug 22 of the pilot burner is first supplied with power and fuel is supplied to the glow plug chamber via fuel supply pipe 28. At the same time combustion air is supplied to the mixing chamber 10 via air supply pipe 18; due to the tangential flow direction into the mixing chamber 10 this air causes a rotating current. The fuel which hits on the protective tube heated up by the glow plug 22 evaporates and mixes in the mixing chamber 10 with the combustion air. When a certain temperature is reached, the fuel-air mixture ignites and the flame sparks through the mixture outlet 13 into the connected combustion chamber of the combustion device.

What is claimed is

1. Pilot burner for a combustion device for burning solid particles in the exhaust gas of internal combustion engines, comprising a hollow cylindrical mixing chamber having a closed end and an opposed open end leading to the combustion device, a hollow cylindrical glow plug chamber connected to the mixing chamber transversely thereof, a glow plug comprising a spiral incandescent element coaxially disposed in said glow plug chamber, a thin-walled protective tube of fine meshed wire fabric coaxially enclosing the incandescent element radially spaced therefrom, a fuel supply pipe ending in the glow plug chamber in the proximity of said protective tube, and an air supply pipe ending in the mixing chamber.

2. Pilot burner in accordance with claim 1, wherein the wire fabric of the protective tube is multilayered.

3. Pilot burner in accordance with claim 1 further comprising a sleeve to which the wire fabric of the protective tube is welded, said sleeve having a threaded borehole for said glow plug, said sleeve being separably inserted into said glow plug chamber.

4. Pilot burner in accordance with claim 3 wherein said glow plug chamber has a threaded bore for receiving said sleeve, said sleeve having a hexagonal head outside of said glow plug chamber.

* * * * *